United States Patent [19]

Kochanneck

[11] 4,108,322

[45] Aug. 22, 1978

[54] CIRCULAR MULTISTORY BUILDING WITH A CONVEYOR AND ELEVATOR MOVABLE AROUND THE PERIPHERY

[76] Inventor: Uwe Kochanneck, 81 Neuer Graben, Dortmund, Fed. Rep. of Germany, 46

[21] Appl. No.: 675,188

[22] Filed: Apr. 8, 1976

Related U.S. Application Data

[63] Continuation-in-part of Ser. No. 450,712, Apr. 29, 1974, abandoned, and a continuation of Ser. No. 466,762, Jul. 5, 1974, abandoned, which is a continuation-in-part of Ser. No. 450,712.

[51] Int. Cl.[2] ..... E04H 6/06

[52] U.S. Cl. ..... 214/16.1 A; 214/16.1 R; 214/16.1 CA; 214/16.1 DC

[58] Field of Search ..... 214/16.1, 16.4 A, 16.1 EB, 214/16.1 R, 16.1 EC, 16.1 A, 16.1 B, 16.1 BA, 16.1 BB, 16.1 C, 16.1 CA, 16.1 CB, 16.1 CC, 16.1 CD, 16.1 CE, 16.1 CF, 16.1 D, 16.1 DA, 16.1 DB, 16.1 DC, 16.1 E, 16.1 ED, 16.1 EA

[56] References Cited

U.S. PATENT DOCUMENTS

| | | | |
|---|---|---|---|
| 2,428,856 | 10/1947 | Sinclair | 214/16.1 A |
| 2,676,714 | 4/1954 | Buranelli | 214/16.1 A |
| 3,079,871 | 3/1963 | Brodie | 214/16.1 A X |
| 3,497,087 | 2/1976 | Vita | 214/16.1 A |

FOREIGN PATENT DOCUMENTS

| | | | |
|---|---|---|---|
| 516,918 | 2/1955 | Italy | 214/16.4 A |

*Primary Examiner*—Drayton E. Hoffman
*Assistant Examiner*—R. B. Johnson
*Attorney, Agent, or Firm*—Michael J. Striker

[57] ABSTRACT

An automated multistory garage is provided with a vehicle-repairshop and/or with a vehicle-sales showroom, superposed as circular arrays of vehicle-holding slots for the repairing, storing, showing, and parking of vehicles. In addition space is provided for offices and restaurants. Cars to be repaired are automatically conveyed by automated loading machines to the parking slots of the repair floor which are each provided with lift platforms and which are separated from each other by triangular region wherein the vehicle repair tools are provided and to which car spare parts can be fed automatically from an overlying warehouse floor by means of an electrical circular conveyor working vertically. In addition a passenger lift connects the control the center in the multistory garage with the various floors so that the working of the arrangement can be controlled from this control center.

1 Claim, 7 Drawing Figures

CIRCULAR MULTISTORY BUILDING WITH A CONVEYOR AND ELEVATOR MOVABLE AROUND THE PERIPHERY

CROSS-REFERENCE TO RELATED APPLICATIONS

This application is a continuation of U.S. application Ser. No. 466,762, filed on July 5, 1974, now abandoned. This application is also a C.I.P. of U.S. application Ser. No. 450,712 filed on Apr. 29, 1974, now abandoned. Applicaton Ser. No. 466,762 was a C.I.P. of application Ser. No. 450,712.

BACKGROUND OF THE INVENTION

My present invention relates to a vehicle-repair workshop and/or a car sales location in combination with an automated multistory garage in which are superposed in circular arcs several working areas and wherein the cars to be repaired are transported within the garage by means of automated loading machines.

A car-repairshop nowadays is expected to repair cars, sell spare parts for cars, and even sell new cars. In addition to these activities it is necessary that considerable paperwork be carried out. The working areas for the vehicles are usually situated on the same level in a relatively large open area wherein considerable space is wasted for the necessary access roads and parking areas necessary for moving cars around within the area, while at the same tme maneuvering the vehicles and securing materials for repair takes considerable time for the shop personnel.

SUMMARY OF THE INVENTION

It is an object of this present invention to provide an automated multistory garage provided with car-repair facilities of the above-described general nature.

Another object is to provide such a garage which economically uses its interior space in a manner standard to present-day construction using reinforced-concrete building.

Yet another object is to provide such a garage which allows for automatic conveyance of the cars as well as of the necessary materials for repairs from one location to another within the garage.

These objects are attained according to the present invention by combining various assemblies so as to produce a novel garage structure.

SPECIFIC DESCRIPTION OF A PREFERRED EMBODIMENT

The garage according to the present invention functions generally along the lines described in my above-cited application 450,712.

In accordance with the present invention there is provided a different relationship between the various parking levels 1 and the control center 6.

Figure 1:
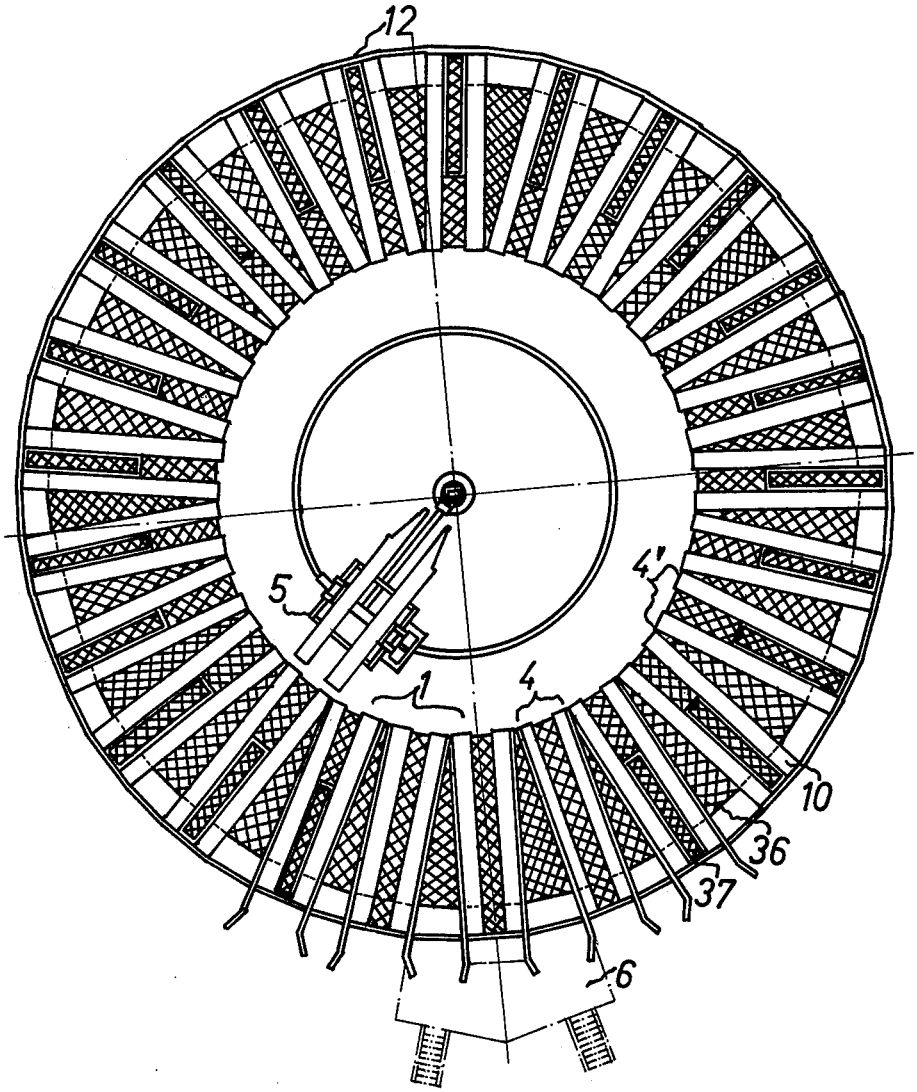
FIG. 1 is a top view of a level of an automated multistory garage at tne entrance and exit level.
Figure 2:
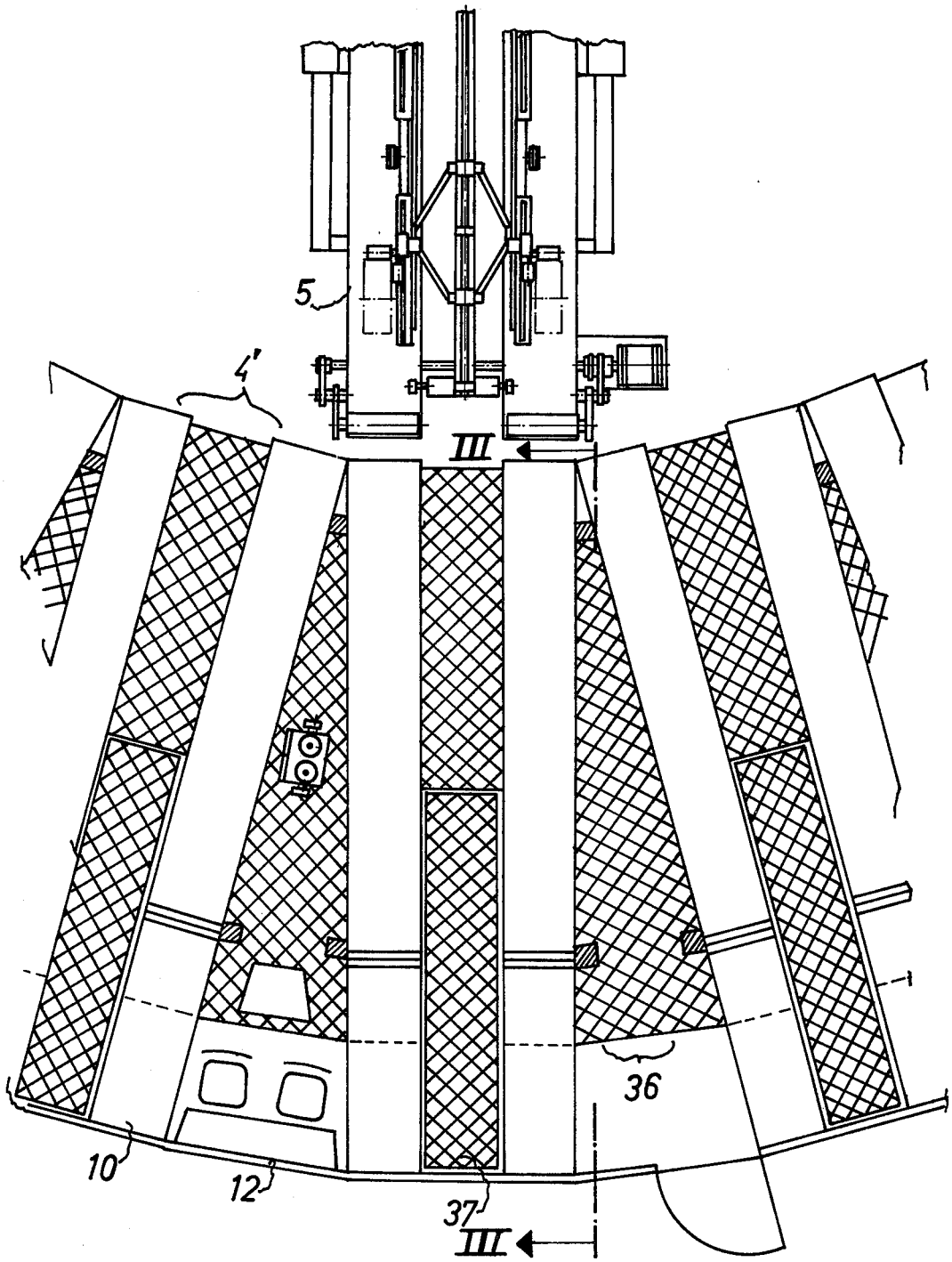
FIG. 2 is a vertical view of a segment of the garage of FIG. 1 at the repair level.
Figure 3:
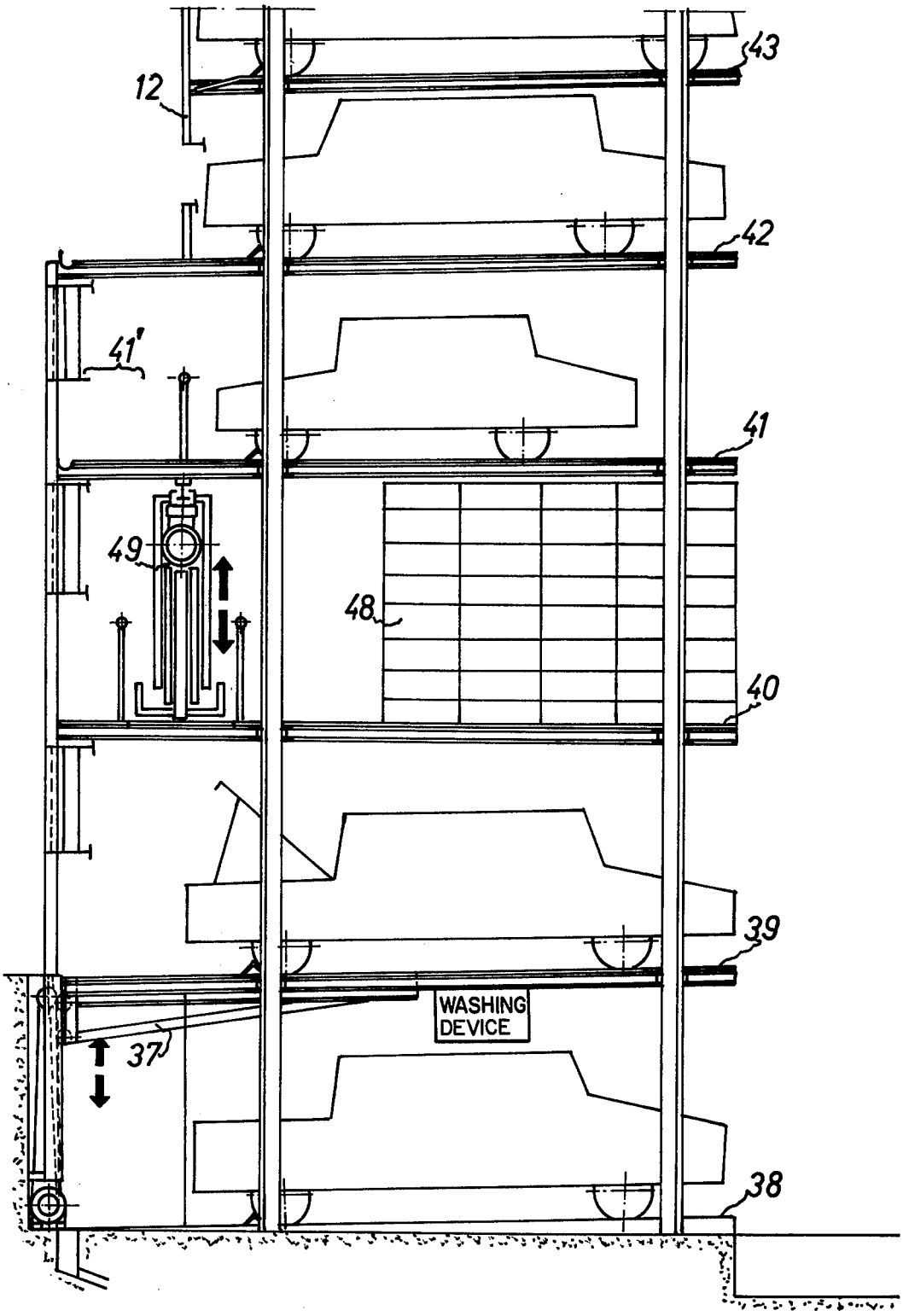
FIG. 3 is a section taken along line III—III of FIG. 2.

FIGS. 1 and 2 show how the parking levels 1 are set up at different floors or storing levels. The level where vehicles can enter and exit from the structure there is provided the repair level 39 (FIG. 3). For this purpose triangular spaces 36 are covered with grids between the base paths 10 of the individual parking places 4, as well as between the parking spaces 4'. Vertical lift platforms 37 are also provided at the parking places 4' as shown in FIG. 3. Each of the parking places 4' is elongated sufficiently toward the wall panels forming the outer periphery of the level 39 so as to allow space around the car to work on them. The trangular regions 36 can be used by the necessary tools, for example welding devices, and for work-benches. In addition, power line hook-ups are provided at each of the spaces 36. Thus it is possible to repair a car in any of the spaces or slots 4'.

Figure 4:
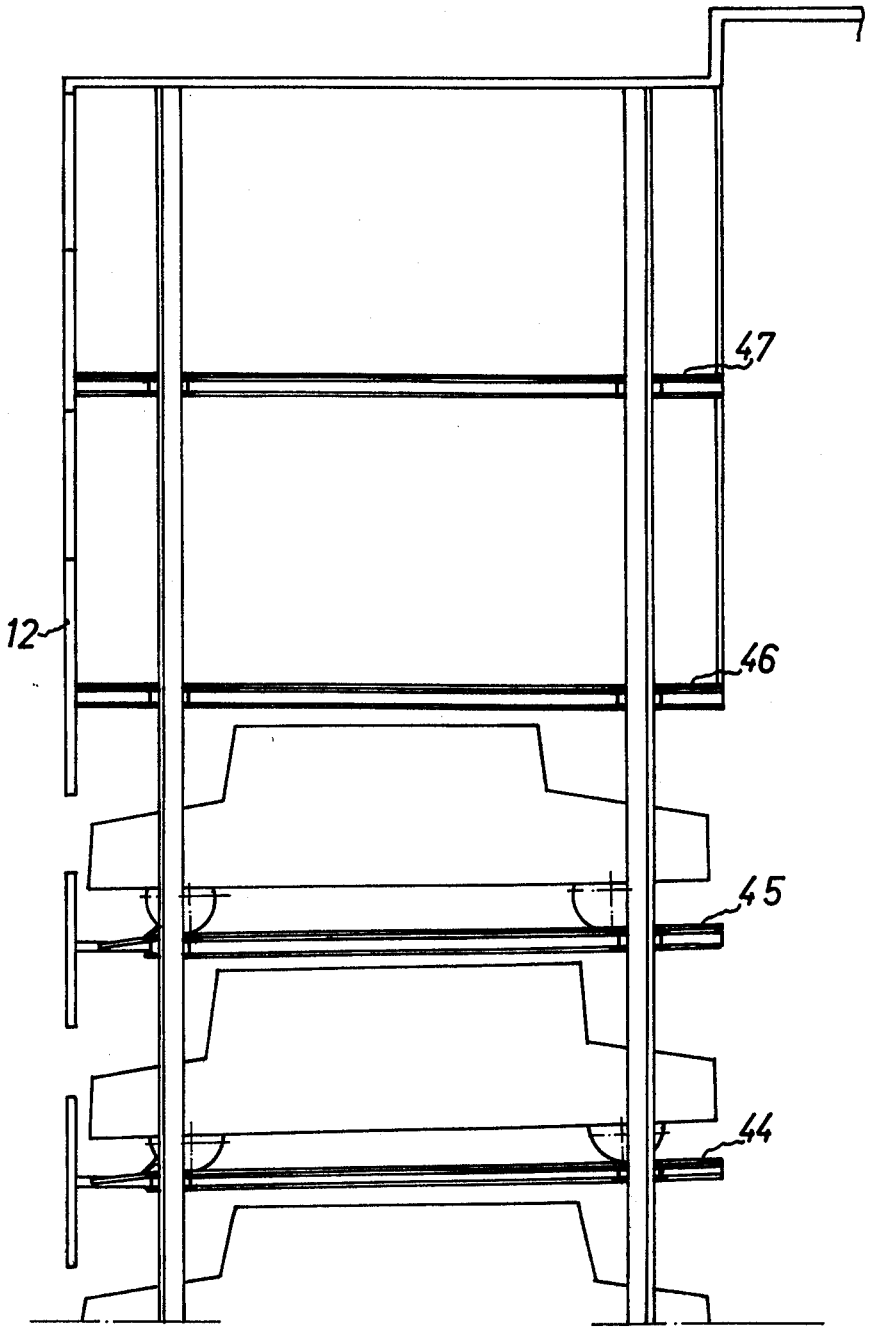
FIG. 4 is another vertical section through the upper levels of the garage according to this invention.

FIGS. 3 and 4 show a bottom floor 38 which can be used for repair and which can be provided with car-washing machines. The level 40 above the level 39 is separated therefrom by a closed ceiling. This level 40 serves to hold spare parts. The spare parts are stored within racks 48 at the level 40. These spare parts are fed to the parking slots 4' of the floor 39 by means of an electrical circular conveyor 49 which is controlled automatically. This conveyor 49 can extend down to the floor 39 in the region of the spaces 36 of each of the parking slots 4'. Above the level 40 there is the level 41 which here serves as a showroom for car selling. The cars on display can be viewed from the outlying passage 41'. The overlying floors or levels 42 to 45 serve as parking areas as described in my above-cited patent application 450,712. The level 46 houses offices and the level 47 is provided for a restaurant.

Figure 5:
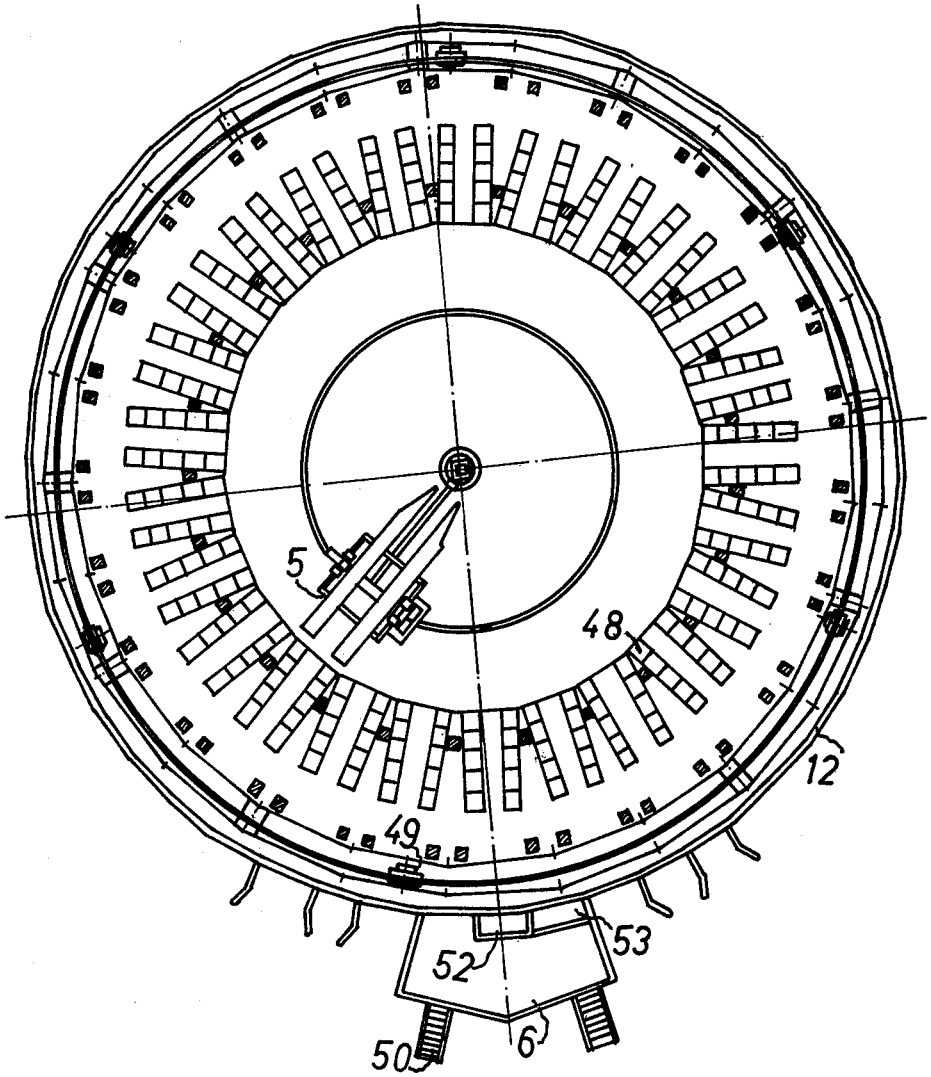
FIG. 5 is a top view of that level of the garage of FIG. 1 directly above the entrance and exit level shown in FIG. 1.
Figure 6:
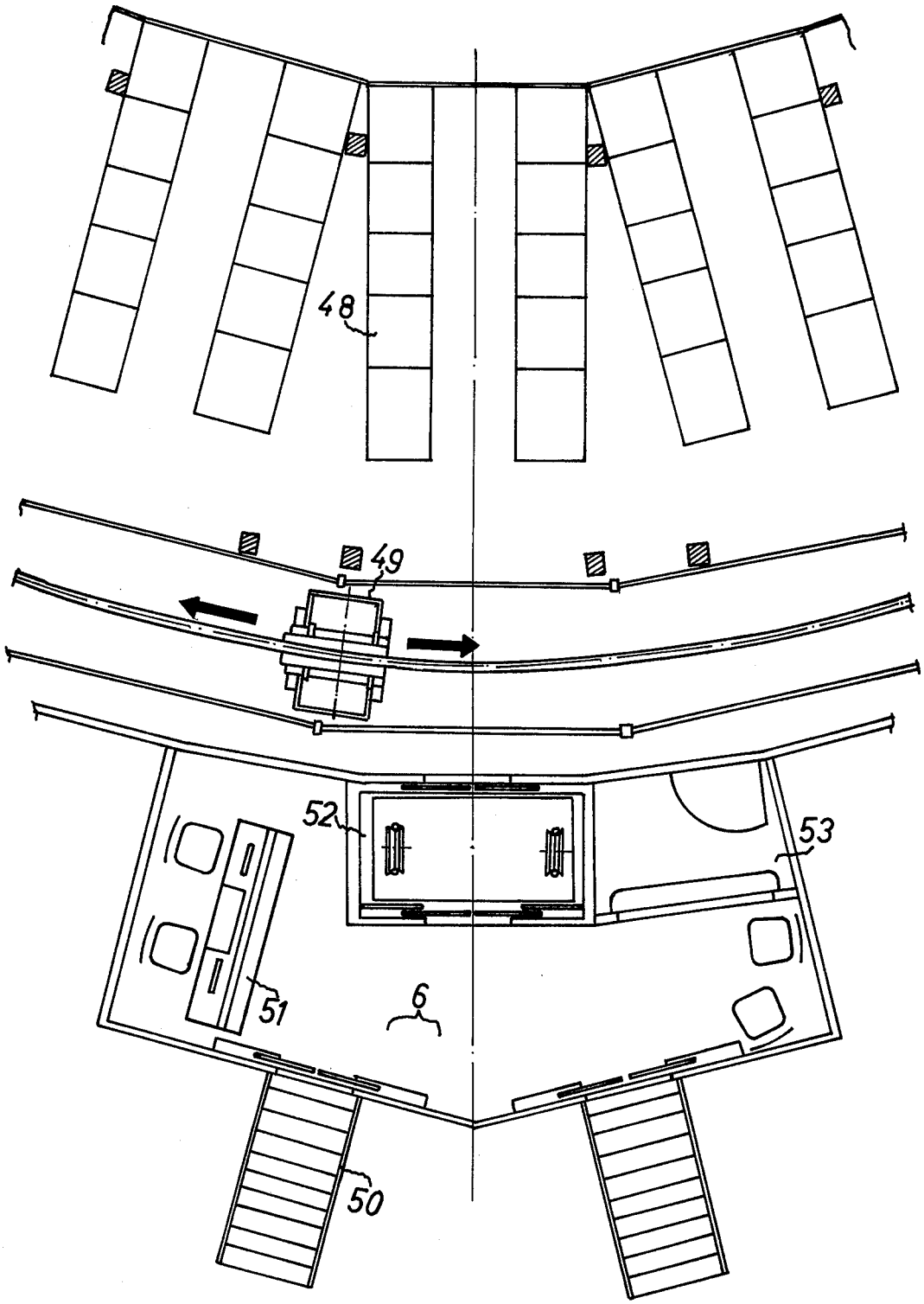
FIG. 6 is a large-scale view of a detail of FIG. 5.
Figure 7:
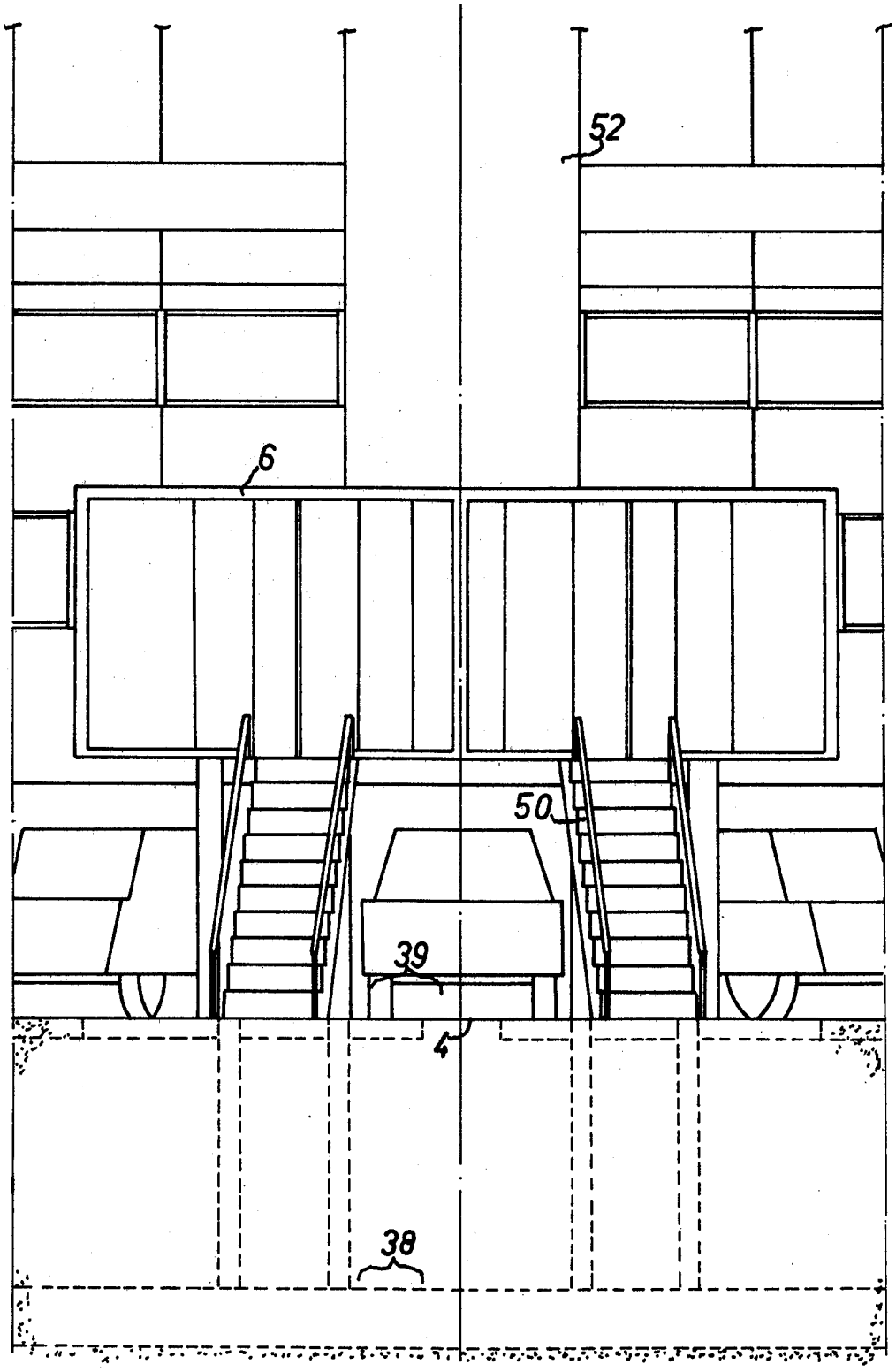
FIG. 7 is a front elevational view of a portion of the garage according to this invention at the repair level and showing the employee entrance.

FIGS. 5 – 7 show the control center 6 located at the level of the floor 40 and extending laterally from the garage according to this invention. Access can be had to the control level 6 from the entrance and exit level by means of two stairways 50. Within the control center 6 there is provided a control desk 51 which serves for the transmission of commands for the automatic parking and unparking of cars by means of the machines 5, as described in my application 450,712. A passenger elevator 52 connects the floors 41, 46 and 47 with one another and with the control center 6. This control center 6 moreover has an area 53 for incoming orders. The orders dispatched from region 53 include orders for the delivery of spare parts. To this end the electrical circular conveyor 49 of the floor 40 can be operated from region 53.

I claim:

1. A multistory structure comprising:

a car-repair level constituting a story of said structure and including a circularly annular array of car-repair slots occupying substantially all but the center of said car-repair level and between said slots regions adapted to support car-repair workers and tools;

a parts-storage level constituting the story of said structure above said car-repair level and including racks for holding car parts;

conveyor means movable around the periphery of the annular array of said repair level and said parts-storage level for transferring parts therebetween;

a display level constituting a story of said structure and having a peripheral walkway and within said walkway a circularly annular array of display slots occupying substantially all but the center of said display level and each adapted to hold a respective car for show;

an office level above said car-repair, parts-storage, and display levels, constituting a story of said structure, and having offices;

a parking level below said office level, constituting a story of said structure, and including a circularly annular array of parking slots for the storage of cars and occupying substantially all but the center of said parking level;

loading means at said centers for vertically displacing cars in said structure between said slots of said car-repair level, said display level, and said parking level; and a control center in said structure including control means connected to said loading means and to said conveyor means for operation thereof from said control center.

* * * * *